US005474289A

United States Patent [19]

Pilling

[11] Patent Number: 5,474,289

[45] Date of Patent: Dec. 12, 1995

[54] SHEET HANDLING DEVICE

[75] Inventor: Roger Pilling, Southampton, United Kingdom

[73] Assignee: De La Rue Systems Ltd., United Kingdom

[21] Appl. No.: 234,349

[22] Filed: Apr. 28, 1994

[30] Foreign Application Priority Data

Apr. 28, 1994 [GB] United Kingdom ..... 9308803

[51] Int. Cl.[6] ..... B65H 7/02

[52] U.S. Cl. ..... 277/265.04; 271/262; 271/274; 33/501.03

[58] Field of Search ..... 271/273, 274, 271/262, 263, 265; 33/501.03, 501.04, DIG. 13

[56] References Cited

U.S. PATENT DOCUMENTS

| | | | |
|---|---|---|---|
| 2,192,414 | 3/1940 | Reed | 271/274 |
| 2,733,063 | 1/1956 | Corey | 271/263 |
| 3,825,343 | 7/1974 | Moore | 33/DIG. 13 |
| 3,826,487 | 7/1974 | Forster | 271/263 |
| 4,560,159 | 12/1985 | Staub | 271/263 |
| 4,605,218 | 8/1986 | Knepper et al. | 271/274 |
| 4,777,729 | 10/1988 | Hausler | 271/263 |

FOREIGN PATENT DOCUMENTS

| | | | |
|---|---|---|---|
| 5-147768 | 6/1993 | Japan | 271/262 |
| 2241228 | 8/1991 | United Kingdom | 271/262 |

OTHER PUBLICATIONS

Patent Abstracts of Japan, vol. 11, No. 62 (P-551) 25 Feb. 1987 & JP-A-61 225 602.7 Oct. 1986.

Patent Abstracts of Japan, vol. 11, No. 98 (M-575) (2545) 27 Mar. 1987 & JP-A-61 248 841, 6 Nov. 1986.

*Primary Examiner*—H. Grant Skaggs

*Attorney, Agent, or Firm*—Ostrolenk, Faber, Gerb & Soffen

[57] ABSTRACT

A sheet handling device comprising a first roller (5) defining a reference surface which defines part of a sheet feed path along which sheets are fed, The roller (5) is mounted to a support (26) by arms (6) such that under normal working conditions the roller is fixed relative to the support, The arms (6) are biassed by a spring (12) to hold the roller (5) in its fixed position, the spring force being such that under abnormal conditions the roller (5) moves relative to the support (26) whereby the reference surface moves away from its sheet feed path defining position.

12 Claims, 4 Drawing Sheets

SHEET HANDLING DEVICE

FIELD OF THE INVENTION

This invention relates to a sheet handling device, for example for use in a sheet thickness detection device.

DESCRIPTION OF THE PRIOR ART

Sheet handling devices are known for handling sheets for a variety of purposes. In many cases, it is necessary to monitor the passage of a sheet in order for example to count the sheet and/or determine its validity. In these and other cases, conventional sheet handling devices include a first member defining a reference surface which defines part of a sheet feed path along which sheets are fed. A typical example of such a sheet handling device is a sheet thickness monitoring or detection device. Measurement of thickness of sheets such as banknotes is often required in order to determine that only single sheets are in transit in a system rather than multiple sheets. The presence of multiple sheets stuck together may result in a miscount, as well as preventing inspection of some of those sheets as they pass through the system.

An example of a conventional sheet thickness detection system is given in British Patent Publication No. GB-A-2241228 which describes a pair of juxtaposed rollers, one of which (the datum roller) is rigidly fixed and the other of which (the sensor roller) is free to move. The sensor roller is restrained from movement by means of rubber inserts so that as a sheet passes through, the rubber deflects and movement of the roller is sensed by shoes riding on the surface of the roller. The shoes displace a sensing element, in this case an LVDT (Linear Variable Differential Transformer), which outputs a signal corresponding to the note thickness. This system encounters a number of problems. The use of shoes on the roller gives rise to wear, and the generation of heat by friction at high speeds. The effect of wear on the shoes is to cause the signal they produce to be different from that when there is no wear. The higher the speed the greater the problems. The signals generated may also be altered by the presence of dirt on the shoes. LVDTs require careful setting up and may give a different signal level from one shoe as from another.

In some applications, for example in banknote processing apparatus such as sorting or counting apparatus, a particular problem arises when monitoring unchecked sheets such as used notes. It is quite common for pins or staples to be present on the note or for there to be adhesive tape or corner folds which affect the sensed thickness. It is desirable that such contaminated notes should pass through the system and be rejected along with suspected double feed notes so that the sorting process need not be halted. In a conventional system where there is a fixed reference roller and a movable sensor roller the presence of staples or pins in a note will cause the sensor roller to be displaced by relatively large amounts with respect to displacement due to a single note. This means that the measurement system must cope with large displacements as well as small ones, resulting in less accuracy in the measurements for small displacements. The use of rubber as a pressure medium for the sensor roller means that large forces are induced due to the passage of a staple which can produce distortion of the rubber. In existing systems, the rubber is the only means of accommodating large bodies and must be capable of deforming sufficiently.

SUMMARY OF THE INVENTION

In accordance with the present invention, a sheet handling device comprises a first member defining a reference surface which defines part of a sheet feed path along which sheets are fed, the member being mounted to a support by a mounting arrangement such that under normal working conditions the member is fixed relative to the support, the mounting arrangement being such that under abnormal conditions the member defining the reference surface moves relative to the support whereby the reference surface moves away from its sheet feed path defining position.

In contrast to known sheet handling devices where jamming or other problems arise, the present invention enables the reference surface itself to move away from the sheet feed path defining position in abnormal conditions and avoid damage to the apparatus.

Typically, the device will further comprise a second member cooperating with the reference surface of the first member such that sheets can be fed between the members in use. In some cases, the first and second members can contact one another while in others they will be spaced apart to define a gap.

This second member could comprise a fixed wall or the like defining a gap through which sheets falling within an acceptable range of thicknesses can pass but typically the second member is movable relative to the reference surface under normal working conditions in response to the thickness of sheets passing between the members.

Preferably, the second member is mounted to a compliant support, the device further comprising measuring means for measuring the strain imparted to the compliant support when a sheet passes between the members so as to monitor displacement of the second member relative to the first member.

The use of strain measurement to monitor displacement of the second member is particularly convenient since this avoids the problems of wear and heat associated with the use of shoes and the like and the consequent variation in output signal encountered in conventional thickness measuring systems. An example of a strain monitoring system is described in JP-A-61248841.

Preferably, the compliant support comprises one or a pair of cantilever arms, a ring, or, a beam fixed at both ends; although other arrangements commonly used in measuring strain may be chosen.

Preferably, the compliant support is a metal support, although other suitable materials such as plastics could be used.

To further improve the accuracy of the device, preferably the device further comprises damping means mounted to the compliant support.

Typically, the means for measuring strain comprises at least one strain gauge mounted to the compliant support.

Preferably, one or both of the first and second members comprise one or more rollers. This is particularly convenient since the or each roller can comprise a feed roller for feeding sheets through the device.

In some cases, movement of the first member may be controlled by a control system which is responsive to the detection of abnormal conditions positively to move the reference surface away from the sheet feed path defining position. For example, an abnormal condition could be detected by a thickness detector which activates the control system to move the first member.

Preferably, however, a passive arrangement is provided in which the mounting arrangement includes biassing means for biassing the first member to its normal, fixed position. The bias force of the biassing means will hold the first member in its fixed position during normal working conditions but is overcome during abnormal conditions. Conveniently, the biassing means comprises a compression spring.

The device according to the invention is particularly suited to the handling of banknotes and other documents of value although it is applicable to the handling of other sheets, for example in photocopying machines and the like. The device may be incorporated into any sheet processing system, for example a sheet thickness detection system, sheet counting system, sheet dispensing or accepting system and the like.

BRIEF DESCRIPTION OF THE DRAWINGS

An example of a thickness detection device according to the present invention will now be described with reference to the accompanying drawings, in which.

DETAILED DESCRIPTION OF THE EMBODIMENTS

Figure 1:
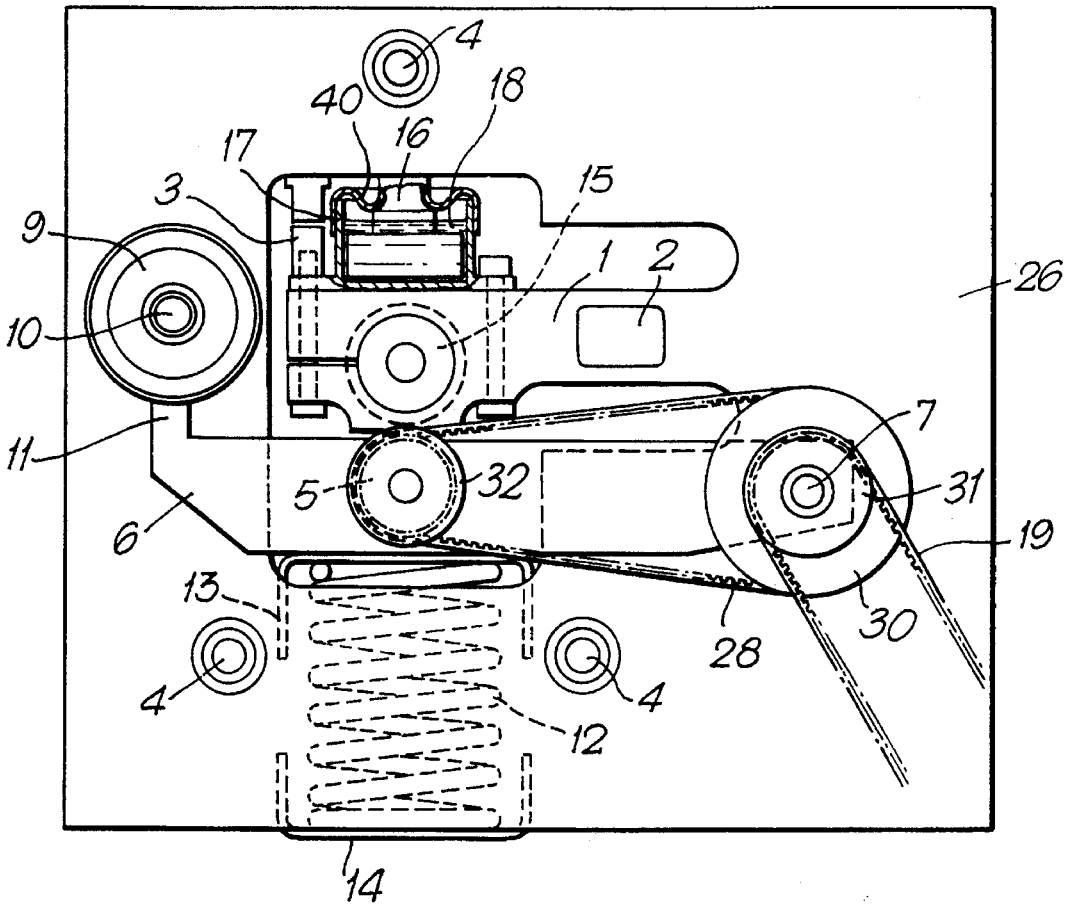
FIG. 1 shows a partly cut away side-view of a thickness detection device in accordance with the present invention.
Figure 2:
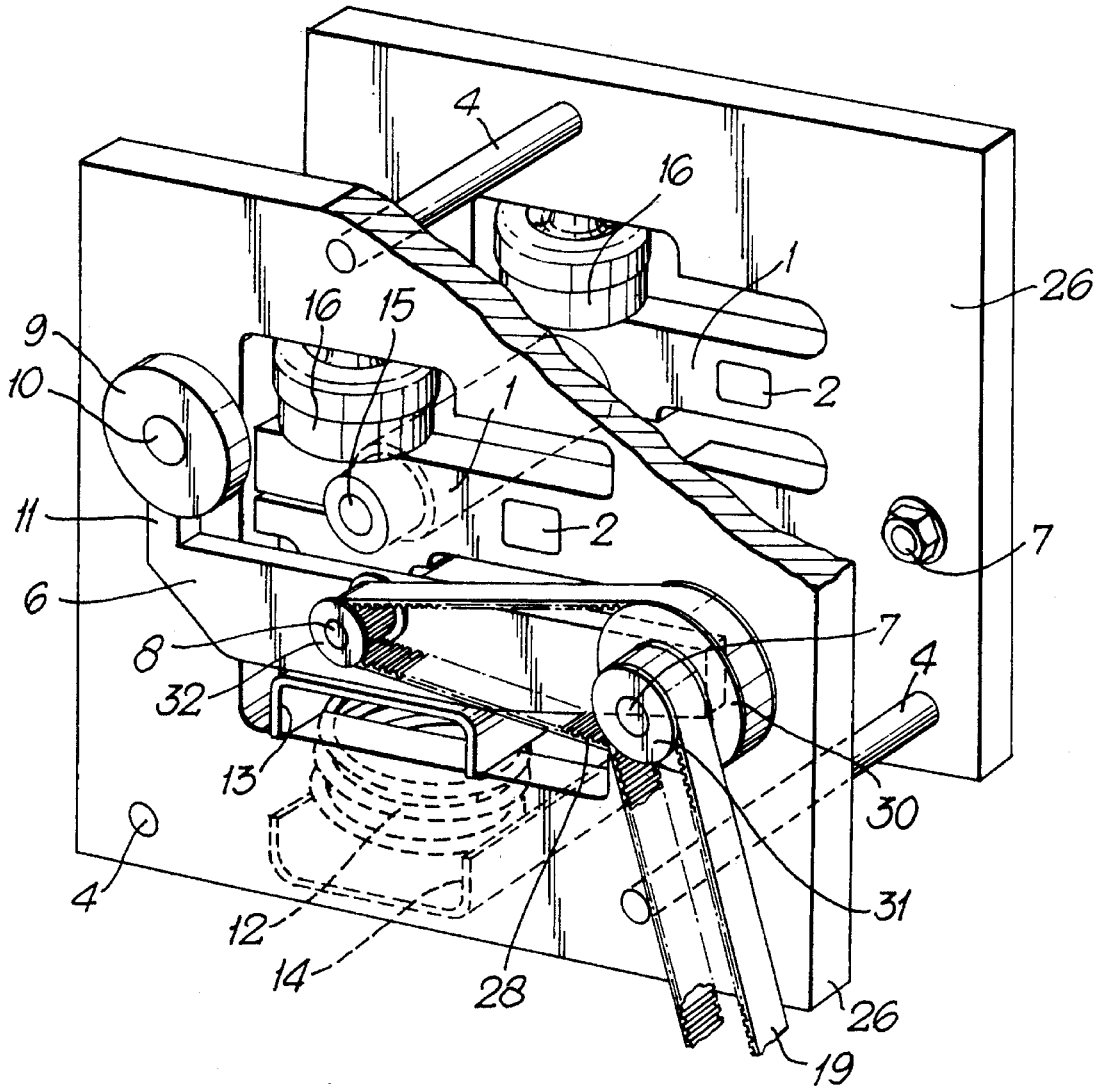
FIG. 2 is a partly cut-away perspective view of the device of FIG. 1.
Figure 3:
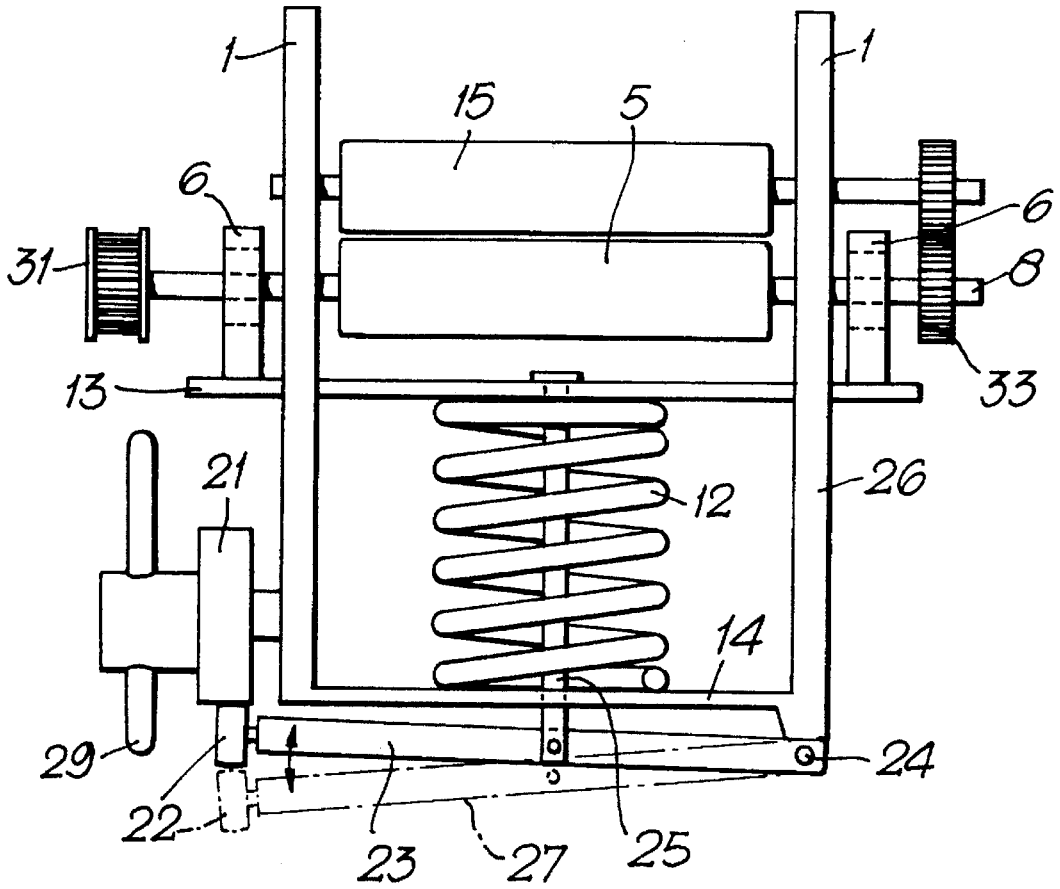
FIG. 3 is a schematic front view of a modified version of the FIG. 1 device.

FIGS. 1–3 show a pair of aluminium side-plates 26 joined together by tie bars 4. Each of the pair of aluminium side-plates 26 is machined to form a cantilever arm 1. Each cantilever arm 1 is provided with one or more strain gauges 2 fixed in such a way that the displacement of a sensor roller 15 rotatably mounted in bearings between remote ends of the cantilever arms can be measured by the, or each, strain gauge 2 as a function of the strain imparted to the arm(s). The, or each, strain gauge 2 is configured as a full Wheatstone bridge circuit (not shown) in a conventional manner and is connected to a microprocessor (not shown) which determines displacement of the roller 15 from the measured strain(s) and controls operation of the device accordingly. A dead stop 3 fitted to each arm 1 limits upward movement of the cantilever arms 1.

A datum roller 5 defining a reference surface and typically made of hardened steel is non-rotatably mounted on a shaft 8 mounted for rotation in bearings in a pair of support arms 6. The pair of arms 6 are pivotally mounted on pins 7 in the side plates 26. Drive is imparted to the datum roller shaft 8 via a toothed pulley 30 around which is entrained a belt 28 which is also entrained around a pulley 32 non-rotatably fixed to the shaft 8. Transmission to the pulley 30 is by means of a pulley 31 which is connected by a timing belt 19 to a drive motor (not shown). To restrain the arms 6 from clockwise rotation about the pins 7, stops are fitted comprising eccentric (snail) cams 9 on pins 10 mounted to side plates 26, and cooperating anvils 11 on the arms 6.

As shown in FIG. 3, the two rollers 15,5 are connected by intermeshing gears 20,33 on the roller shafts projecting outside one of the side-plates 26.

Figure 4:
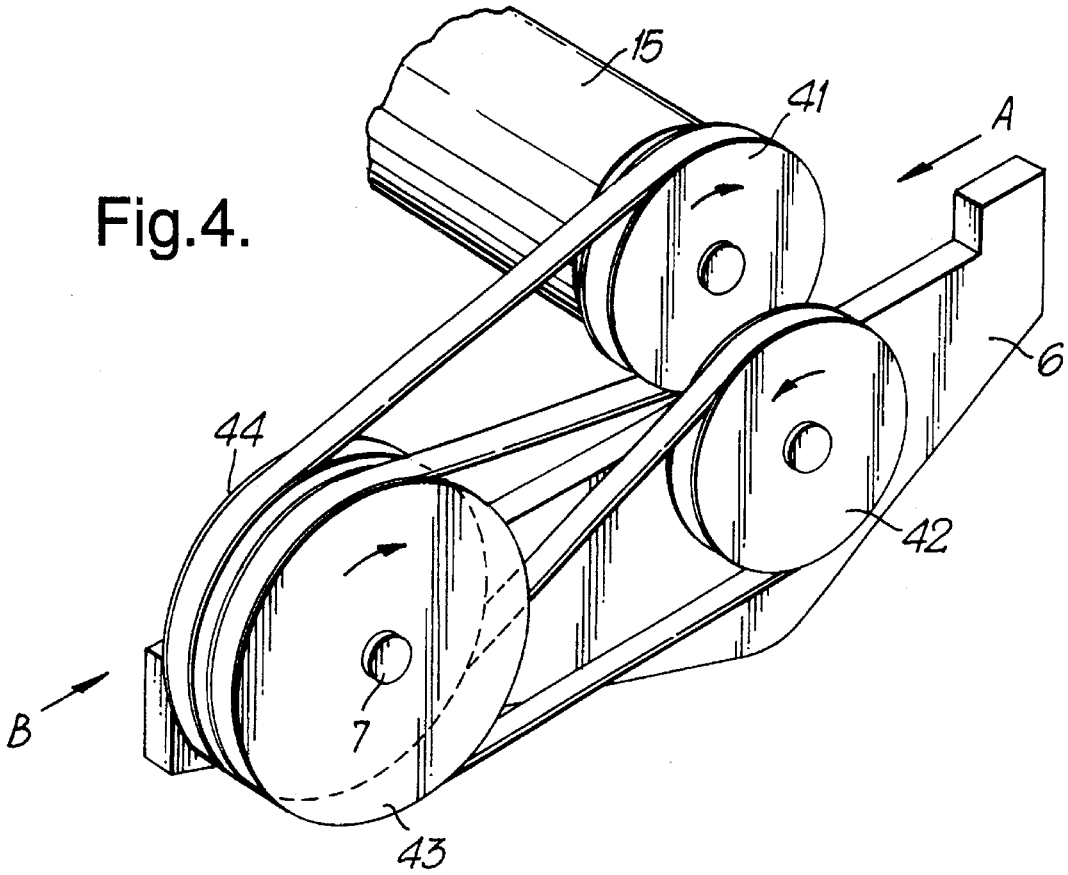
FIG. 4 illustrates a modified roller drive system.
Figure 4A:
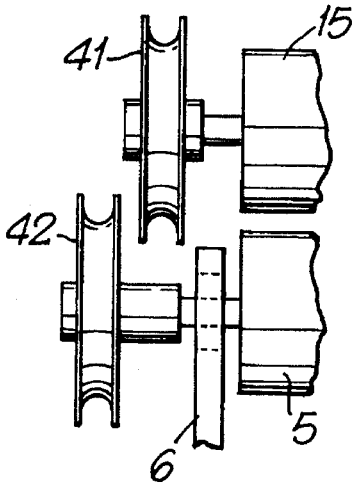
FIG. 4A is a side view of the roller drive system of FIG. 4, shown in direction A of FIG. 4.
Figure 4B:
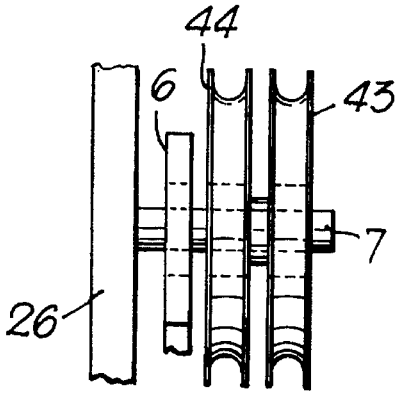
FIG. 4B is a side view of the roller drive system of FIG. 4, shown in direction B of FIG. 4.

In an alternative arrangement, the rollers 15,5 are driven by a drive belt and pulley system. Such a pulley and drive belt system is shown in FIG. 4, FIG. 4A and FIG. 4B where the drive gears 20 and 33 are replaced by "O"-ring pulleys 41 and 42 respectively.

The pulleys are driven by a single "O"-ring drive belt, 45, which is an elastic belt of circular cross-section. The belt takes a figure of eight path around a pair of idler pulleys 44 and 43 which are conveniently rotatably mounted on the same pivot pin 7 as the arm 6 is mounted on. This ensures that there is no alteration in the fitted tension in the belt even during the largest movements of the arm 6, since the pulleys remain at fixed centres. Two passes of the belt have to run at an angle to the plane of the pulley faces but this type of drive belt can accept this. The pulleys 43 and 44 can rotate independently of one another.

This twisted "O"-ring belt drive scheme causes a reversal of rotational direction as do the gears it replaces, but without the risk of certain problems which can arise with the gears. For example, the gears can be noisy at high speeds in comparison to the belt and since they move apart slightly during the passage of each document, this is thought to promote more rapid tooth wear. When the rollers are separated for jam clearance, the gears can go out of mesh and sometimes do not go back into mesh afterwards as the teeth could sit on each other at the tips. The gears will go back into mesh as soon as rotation started but with an accompanying loud noise as they drop into mesh.

A compression spring 12 placed centrally between the side plates 26 applies a controlling force on the arms 6 in the clockwise direction and acts upon a bridge bar 13 which extends underneath and is fixed to both arms 6. A similar bridge bar 14 spans the two side plates 26 underneath, and holds the spring 12 in compression.

For the particular application of measuring thickness of banknotes in order to count the notes, thicknesses of up to two notes need to be accurately measured. If more than two notes are sensed between the rollers 15,5 then it is assumed that the sheets passing will be rejected. Measurement above single note thickness is made to determine the difference between single and double notes or to evaluate the amount of contamination on a note e.g. tape. Movement of the cantilever arm 1 is limited by the dead stop 3 fitted to the arm. The limit of movement will be typically three notes thickness, after which further bending of the cantilever arm 1 is prevented so that permanent damage is not caused to either the arm or the strain gauges 2.

When no note is being fed, the datum roller 5 and sensor roller 15 are usually set up to have a small gap between them. This gap is less than the thickness of one note and means that the cantilever arm 1 is under no load at the start of a measurement operation and that there is no contact between the rollers 5,15 which can produce undesirable noise and wear. The larger this gap the smaller the impact of a sheet entering the rollers, i.e. the overall signal strength is reduced because the sensor roller does not have so far to move to ride over a note. In some cases, however, the rollers 5,15 may contact each other.

In operation, sheets such as banknotes are fed by conveyor belts or rollers (not shown) to the nip defined between the rollers 5,15. Initially, when there is no sheet between the sensor roller 15 and the datum roller 5 there is no force on the cantilever arms 1 other than the weight of the sensor roller 15. The passage of a sheet or sheets between the sensor roller 15 and datum roller 5 exerts an upward force on the arms 1 which causes shear stress in the arms while the datum roller 5 remains in a substantially fixed position relative to the side plates 26 due to the force of the spring 12. This shear stress is measured as an imbalance in the full Wheatstone bridge connected strain gauges 2. This produces an output voltage proportional to the thickness of the sheet or sheets passing through which can be used for the purpose of detecting single or double sheets and the like in a conventional manner.

Strain gauges are commonly used to detect levels of stress and strain in materials, but in this example what is being measured are the deflections which produce the strain or stress in the arms 1. The arm 1 has compliance, i.e. the arm is capable of bending under loads imposed as a sheet passes between the sensor roller 15 and the datum roller 5.

The shape of the cross section of the arm 1 is chosen to provide an arm of correct proportions for mounting the or each strain gauge 2 and for bending with the desired load displacement characteristics. The stiffness of the arm 1 is defined by the thickness of the aluminium side-plate 26, the depth of section of the arm 1 and the length of the arm. The dimensions chosen provide an arm 1 with sufficient rigidity to force the sensor roller 15 to move at speeds fast enough to measure the features of interest on the sheet, i.e. to keep the natural frequency high whilst not being so great that compressive damage to the sheets might occur. The length of the arm 1 is kept short so that the physical size of the sheet handling system is minimised. The strains which the arm 1 experiences in service and the levels of strain in the gauges 2 themselves are kept to a low level so that no fatigue occurs in use.

As the or each strain gauge 2 is bonded to the cantilever arm prior to installation in a note handling system they require no further adjustment. If desired a replacement side-plate may be provided without requiring setting up operations so that the assembly is quicker and cheaper to use than LVDTs (linear voltage displacement transducers). Strain gauges are accurate and sensitive and have a high fatigue life as they are designed to be used only for low strains. The signal gain produced from each arm is predictable and does not need to be adjusted when assembled. A side-plate can be manufactured with all the provisions of mounting the sensor and datum rollers and ancillary items incorporated so that production costs are kept low and replacement in the field is simplified.

Although in this example two cantilever arms 1 are mounted with the strain gauges 2, it is possible to have one or more strain gauges mounted on only one arm.

As an alternative to the cantilever arm 1, the sensor roller 15 may be fitted in a deflecting, support for example in the form of a ring of metal which is squashed by deflection of the sensor roller, or a beam fixed at both ends. Other shapes commonly used in strain gauge load cells are U-shape or S-shape which can be designed to have an appropriate amount of deflection for the load desired in this application.

A mass such as roller 15, supported on a spring element such as cantilever arm 1, can be unstable since a forcing vibration can cause the system to resonate and large amplitudes of movement are possible. This would cause the signals obtained from the strain gauges 2 to be unreadable as oscillations of the roller 15 would mask the inclusions on the surface of the note which were required to be measured. The device therefore uses viscous damping as a means of removing the energy in the system which causes unwanted oscillations on the output signals. Damping produces a stable system whereby the roller 15 accurately tracks the surface of the note. Thus, to each side-plate assembly 26 is fitted a simple piston 16 which is rigidly connected to the side-plate. As shown in FIG. 1, a lightweight cup 17 is rigidly fixed to the cantilever arm 1 and filled with oil to a level 18 in which the piston 16 is received. A simple convolute elastomeric seal 40 prevents any oil leaking from the system during handling or storage but is not an essential part of the system.

System damping can be more easily controlled than in a system where rubber is relied on to provide the resilient mounting, the restoring damping force for system stability and zero positioning of the roller. By separating these variables it is possible, for example, to increase system stiffness whilst maintaining damping at the same value. This is a particularly useful feature in the system described where the need for increased throughput creates higher running speeds and more arduous dynamic conditions than previously encountered.

The sensor and datum rollers 5,15 are produced from metal and there is no rubber used in their mountings. This gives the thickness detection device an inherent temperature stability which is lacking in the prior art. Since the coefficient of expansion of rubber is greater than that of metal the possibility of mechanical settings drifting due to temperature changes is minimised by using the strain gauge system. In a strain gauge using a wheatstone bridge circuit the effects of temperature variations tend to be self cancelling. In one particular configuration (not shown) where the strain gauges are arranged back to back, on a thin shear web at the neutral axis, this self-cancelling feature is particularly effective and no significant change in signal at the output of the bridge will be produced due to temperature variation.

In the system described, the datum roller 5 remains fixed whilst measuring note thickness, but it is able to move away from the sensor roller when abnormal conditions occur, such as the passage of large bodies. This protects the sensor roller from being subjected to undue strain when a large item passes between the rollers 5,15.

A controlling force is applied to the datum roller support arms 6 by the spring 12 to keep the anvils 11 of the arms against the adjustable cams 10. The amount of force applied is just sufficient to keep the datum roller 5 in its fixed position for all normal note thickness measurements, but light enough to be overcome when an undesired thickness due to the passage of too many notes or the passage of staples or other such large items passes through the nip between the rollers 15,5. When a large item passes through the rollers, the datum roller 5 is forced downwards away from the cams 10 against the bias of spring 12 and then recovers its original position when the item has passed.

The force of the spring 12 is matched to the load/displacement characteristic of the cantilever arm 1 such that the datum roller arms 6 begin to separate from the cams 10 when three notes attempt to pass through. The coil spring 12 is a long spring compressed to a short length which means that whilst the preload force exerted by the spring 12 is appreciably high, the increase in force experienced in the system during the passage of e.g. a staple is not as great as it would be if the datum roller 5 were fixed and the cantilever arm 1 had to take the whole of the movement. The rate or force per unit displacement of the cantilever arm 1 is very much higher than of the compression spring and it is this balance between these two spring forces which enables the system to respond to overload conditions without causing permanent damage to the measurement system 2 or the bearings. It is a fail safe mechanism which limits the amount of force which can be applied between the two rollers 5,15. The two intermeshing gears 20,33 move apart slightly when notes pass through the system and move even further apart for the passage of pins and staples, going back into full mesh afterwards. The datum roller 5 can move several millimeters, a distance much larger than normally encountered with staples and pins.

The controlling force does not necessarily need to be applied with a compression spring. Tension springs, torsion springs or even rubber could be used provided that they apply the correct amount of preload and have the load/displacement characteristic required.

FIG. 3 illustrates a modification in which a mechanism enabling roller separation for jam clearance to be achieved. This includes a snail cam 21 mounted to a side plate 26 and which can be rotated through almost a full revolution. The cam 21 acts upon a cam follower 22 and the shape of the cam 21 provides both a convenient stop for the motion and a detent to hold the rollers 15,5 apart until required to be released. Cam follower 22 is fixed to the end of horizontal bar 23 which is pivotally mounted at 24 to the other side plate 26.

A vertical link 25 connects the bridge bar 13 to the centre of the horizontal bar 23 and pulls down the bridge bar hence releasing the rollers upon rotation of the cam 21. The bar 23 moves to the approximate position shown by dotted line 27 and produces a movement of two or three millimeters at the rollers. For convenience of operation the snail cam 21 is fitted with a handle or knob 29.

I claim:

1. A sheet handling device comprising a first member defining a reference surface which defines part of a sheet feed path along which sheets are fed a support and a mounting arrangement said first member being mounted to said support by said mounting arrangement such that under normal working conditions said first member is fixed relative to said support, said mounting arrangement being such that under abnormal conditions said first member defining said reference surface moves relative to said support whereby said reference surface moves away from its sheet feed path defining portion, a second member cooperating with said reference surface of said first member such that sheets can be fed between the members, said second member being movable relative to said reference surface and said support under normal working conditions in response to the thickness of sheets passing between said members.

2. A device according to claim 1, wherein said second member is mounted to a compliant support, said device further comprising measuring means for measuring the strain imparted to said compliant support when a sheet passes between said members so as to monitor displacement of said second member relative to said first member.

3. A device according to claim 1, wherein said compliant support comprises one of a cantilevered arm, a ring, and a compliant beam fixed at both ends.

4. A device according to claim 2, wherein said means for measuring strain comprises at least one strain gauge mounted to said compliant support.

5. A device according to claim 1, wherein said second member comprises a roller.

6. A device according to claim 5, wherein said first member comprises a roller.

7. A device according to claim 6, wherein said biassing means comprises a compression spring.

8. A device according to claim 1, wherein said roller comprises a feed roller.

9. A device according to claim 1, wherein each of said first and second members comprises a roller.

10. A device according to claim 1, wherein said mounting arrangement includes biassing means for biassing said first member to said normal, fixed position.

11. A device according to claim 1, wherein said mounting arrangement includes at least one arm pivoted to said support.

12. A device according to claim 1, wherein said abnormal condition corresponds to the passage of an article to or along said reference surface having a thickness greater than a predetermined amount.

* * * * *